US012324516B2

(12) United States Patent
Chen et al.

(10) Patent No.: US 12,324,516 B2
(45) Date of Patent: Jun. 10, 2025

(54) FURNITURE SYSTEM AND FURNITURE ASSEMBLY THEREOF

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Fang-Cheng Su, Kaohsiung (TW); Yue-Hua Tang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 139 days.

(21) Appl. No.: 18/347,002

(22) Filed: Jul. 5, 2023

(65) Prior Publication Data

US 2024/0298794 A1 Sep. 12, 2024

(30) Foreign Application Priority Data

Mar. 6, 2023 (TW) ..... 112108391

(51) Int. Cl.
*A47B 88/95* (2017.01)

(52) U.S. Cl.
CPC ..... *A47B 88/95* (2017.01); *A47B 2088/951* (2017.01); *A47B 2088/954* (2017.01)

(58) Field of Classification Search
CPC ..... A47B 88/95; A47B 2088/951; A47B 2088/954; A47B 88/944
See application file for complete search history.

(56) References Cited

U.S. PATENT DOCUMENTS

| | | | | |
|---|---|---|---|---|
| 4,802,716 | A * | 2/1989 | Rock | A47B 88/956 312/263 |
| 5,265,953 | A * | 11/1993 | Rock | A47B 88/95 312/348.4 |
| 5,385,248 | A | 1/1995 | Klein, Jr. | |
| 8,002,366 | B2 * | 8/2011 | Fitz | A47B 88/944 312/348.4 |
| 8,931,862 | B2 * | 1/2015 | Grimm | A47B 88/944 312/348.4 |
| 9,033,435 | B2 * | 5/2015 | Gasser | A47B 88/941 312/348.2 |
| 9,060,605 | B2 * | 6/2015 | Gasser | A47B 88/427 |
| 10,327,550 | B2 * | 6/2019 | Held | A47B 88/941 |

(Continued)

FOREIGN PATENT DOCUMENTS

| | | | | |
|---|---|---|---|---|
| AT | 15125 U1 * | 11/2016 | | |
| AT | 518790 B1 * | 1/2018 | | A47B 88/931 |

(Continued)

*Primary Examiner* — Hanh V Tran
(74) *Attorney, Agent, or Firm* — Best & Flanagan LLP

(57) ABSTRACT

A furniture assembly includes a panel, a connecting member and an auxiliary device. The panel has a first side and a second side. The connecting member is arranged adjacent to one of the first side and the second side of the panel. The connecting member includes a first part and a second part. The first part is configured to be connected to the panel. The auxiliary device is configured to be mounted to the second part of the connecting member. The auxiliary device is configured to increase a height of the furniture assembly above the panel. The present invention also provides a furniture system.

10 Claims, 8 Drawing Sheets

(56) References Cited

U.S. PATENT DOCUMENTS

| | | | | |
|---|---|---|---|---|
| 11,122,895 | B2 * | 9/2021 | Kampl | A47B 88/95 |
| 2010/0102692 | A1 * | 4/2010 | Hammerle | A47B 88/956 312/348.4 |
| 2020/0345141 | A1 * | 11/2020 | Kampl | A47B 96/20 |
| 2021/0259418 | A1 * | 8/2021 | Chen | A47B 88/95 |

FOREIGN PATENT DOCUMENTS

| | | | | |
|---|---|---|---|---|
| AT | 520636 | B1 * | 6/2019 | A47B 88/941 |
| AU | 2009265847 | A1 * | 1/2011 | A47B 88/95 |
| CN | 111870072 | A * | 11/2020 | A47B 88/941 |
| CN | 111904185 | A * | 11/2020 | A47B 88/417 |
| CN | 112056827 | A * | 12/2020 | A47B 88/90 |
| DE | 3024972 | A1 * | 1/1982 | |
| DE | 3135788 | A1 * | 8/1982 | |
| DE | 4330919 | A1 * | 3/1995 | A47B 88/00 |
| DE | 20305283 | U1 * | 6/2003 | A47B 81/002 |
| DE | 202008009507 | U1 * | 12/2008 | A47B 88/931 |
| DE | 202008008540 | U1 * | 12/2009 | A47B 88/95 |
| DE | 102008057170 | A1 * | 5/2010 | A47B 88/941 |
| DE | 202012100211 | U1 * | 4/2012 | A47B 77/08 |
| DE | 202011109565 | U1 * | 5/2013 | A47B 88/95 |
| DE | 202012003125 | U1 * | 8/2013 | A47B 88/0055 |
| DE | 202015100770 | U1 * | 6/2016 | A47B 88/941 |
| DE | 102017105798 | A1 * | 9/2018 | A47B 88/925 |
| DE | 202017003832 | U1 * | 11/2018 | A47B 88/95 |
| DE | 202019104971 | U1 * | 1/2021 | |
| EP | 0291781 | A1 * | 11/1988 | |
| EP | 0678254 | A1 * | 10/1995 | |
| EP | 0974291 | A2 * | 1/2000 | |
| GB | 2193430 | A * | 2/1988 | A47B 88/931 |
| JP | 10262758 | A * | 10/1998 | A47B 88/00 |
| KR | 200188099 | Y1 * | 7/2000 | |
| KR | 200377357 | Y1 * | 3/2005 | |
| WO | WO-2009006651 | A2 * | 1/2009 | A47B 88/956 |
| WO | WO2009111807 | A2 | 9/2009 | |
| WO | WO-2012028489 | A1 * | 3/2012 | A47B 88/931 |
| WO | WO-2013003871 | A1 * | 1/2013 | A47B 88/427 |
| WO | WO-2013120894 | A1 * | 8/2013 | A47B 88/941 |
| WO | WO-2019119002 | A1 * | 6/2019 | A47B 88/938 |
| WO | WO-2021037528 | A1 * | 3/2021 | A47B 88/919 |

* cited by examiner

FURNITURE SYSTEM AND FURNITURE ASSEMBLY THEREOF

BACKGROUND OF THE INVENTION

1. Field of the Invention

The present invention relates to a furniture system, and more particularly, to a furniture system and its furniture assembly having at least one auxiliary device to be installed according to user's requirements.

2. Description of the Prior Art

Patent number WO 2009/111807 discloses a drawer. A front panel of the drawer is arranged with a drawer bar comprising a longitudinal arm and two shorter arms extending downwards at right angles. Each of two ends of the drawer bar is provided with a first wall element. Two claw elements are respectively provided on the first wall elements. The claw element is configured to lock a locking element in a form of a planar clamping arm. Thereby, the shorter arms can be clamped between a rear surface of the first wall element and the locking element.

However, in order to meet diverse requirements of the market, it is important to develop various products.

SUMMARY OF THE INVENTION

The present invention relates to a furniture system and its furniture assembly having at least one auxiliary device to be installed according to user's requirements.

According to an embodiment of the present invention, a furniture assembly comprises a first panel, a connecting member and an auxiliary device. The first panel has a first side and a second side. The connecting member is arranged adjacent to one of the first side and the second side of the first panel. The connecting member comprises a first part and a second part. The first part is configured to be connected to the first panel. The auxiliary device is configured to be mounted to the second part of the connecting member, in order to increase a height of the furniture assembly above the first panel.

Preferably, the first panel comprises a bottom part and a top part, and a first predetermined height is defined between the top part and the bottom part of the first panel. When the auxiliary device is mounted to the second part of the connecting member, a second predetermined height is defined between a top part of the auxiliary device and the bottom part of the first panel, and the second predetermined height is higher than the first predetermined height.

Preferably, the second part of the connecting member is extended from the first part, and the second part of the connecting member is extended beyond the top part of the first panel by a predetermined distance.

Preferably, the auxiliary device comprises a first fitting member, a second fitting member and an extension member arranged between the first fitting member and the second fitting member.

Preferably, the auxiliary device is mounted to the second part of the connecting member through the first fitting member.

Preferably, the first fitting member is configured to sleeve the second part of the connecting member.

Preferably, the first panel comprises a predetermined portion, and one of the first fitting member and the second fitting member is arranged with a hook configured to engage with the predetermined portion of the first panel.

Preferably, the hook is elastic.

Preferably, the extension member has a first side end and a second side end, and the first fitting member is configured to be detachably mounted to the first side end.

Preferably, the second fitting member is configured to be detachably mounted to the second side end.

Preferably, the extension member is a rod, and a predetermined space is defined by the extension member, the first fitting member, the second fitting member and the top part of the first panel.

Preferably, the furniture assembly further comprises a side cover. The first fitting member comprises a side part. The side cover is configured to cover the side part of the first fitting member and the first side of the first panel.

According to another embodiment of the present invention, a furniture system comprises a bottom plate, a first side wall, a second side wall, a first panel, a second panel, a connecting member and an auxiliary device. The first side wall and a second side wall are arranged at left and right sides of the bottom plate respectively. The first panel and a second panel are arranged at front and rear sides of the bottom plate respectively. The first panel has a first side and a second side. The connecting member is arranged adjacent to one of the first side and the second side of the first panel. The connecting member comprises a first part and a second part. The first part is configured to be connected to the first panel. The auxiliary device is configured to be detachably mounted to the second part of the connecting member.

Preferably, the first panel comprises a bottom part and a top part, and a first predetermined height is defined between the top part and the bottom part of the first panel. When the auxiliary device is mounted to the second part of the connecting member, a second predetermined height is defined between a top part of the auxiliary device and the bottom part of the first panel, and the second predetermined height is higher than the first predetermined height.

Preferably, the auxiliary device comprises a first fitting member and an extension member connected to the first fitting member. The auxiliary device is mounted to the second part of the connecting member through the first fitting member. The first panel comprises a predetermined portion, and the first fitting member is arranged with a hook configured to engage with the predetermined portion of the first panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
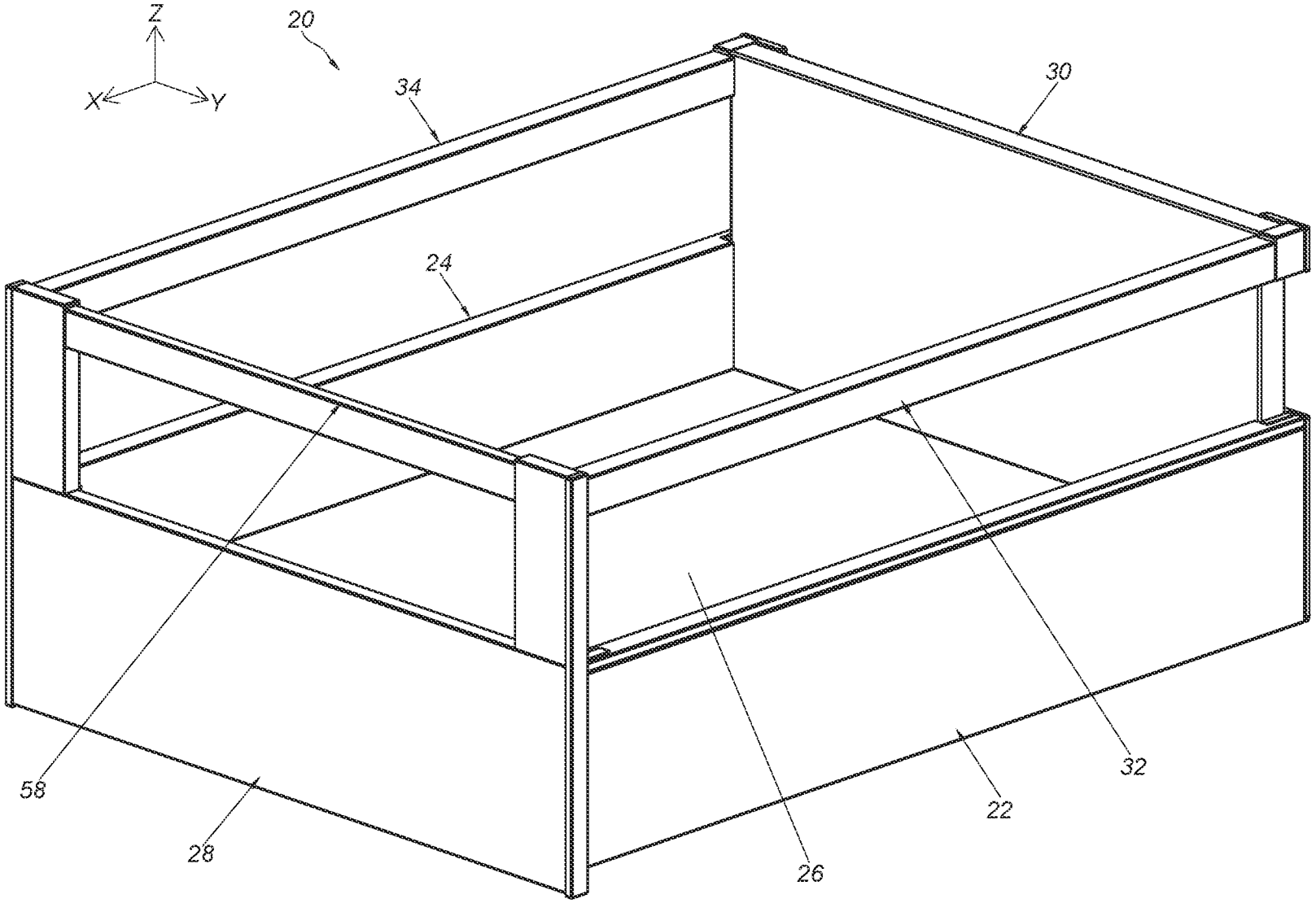
FIG. 1 is a diagram showing a furniture system according to an embodiment of the present invention.
Figure 2:
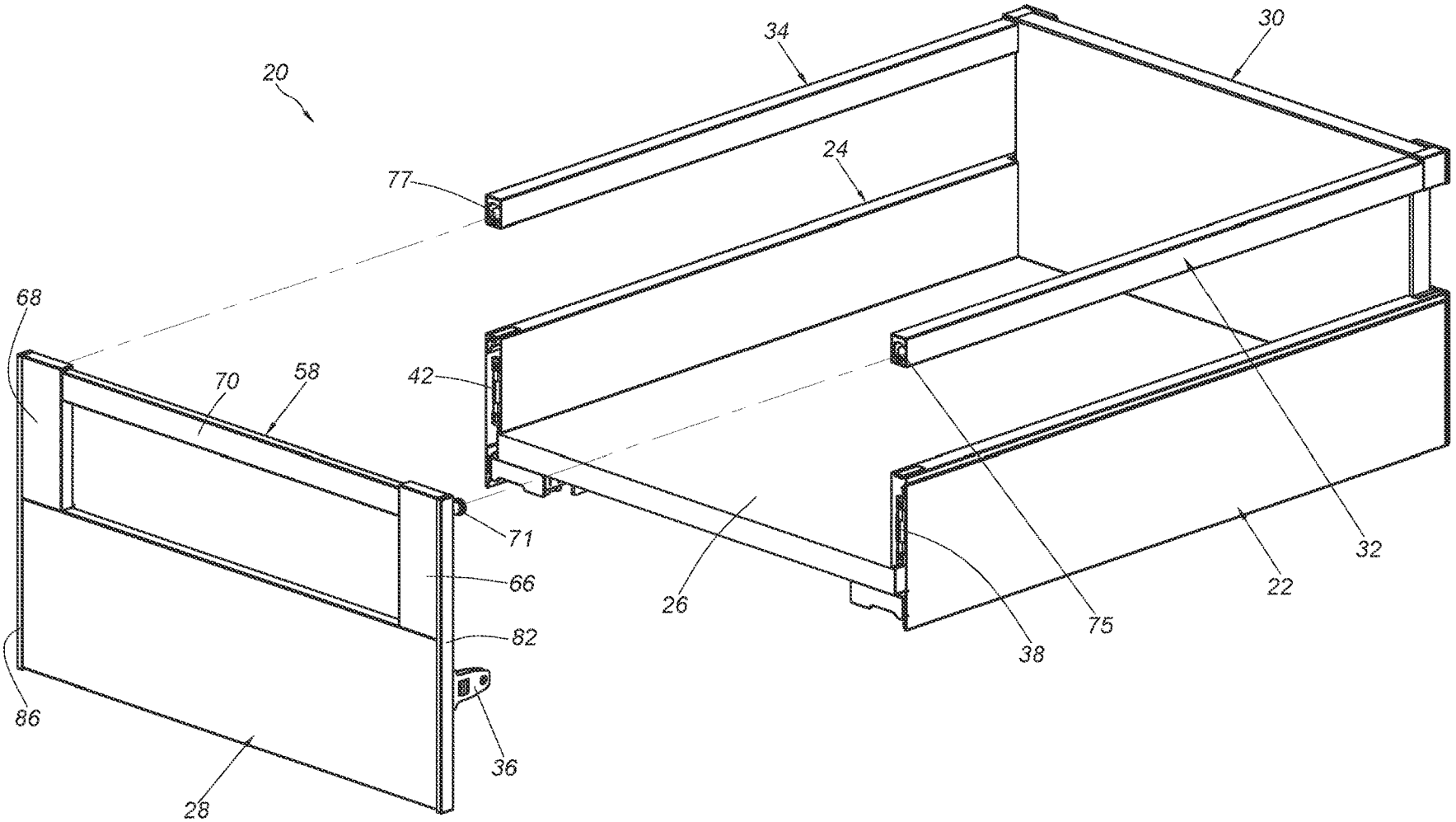
FIG. 2 is an exploded view of the furniture system from a first viewing angle according to the embodiment of the present invention.
Figure 3:
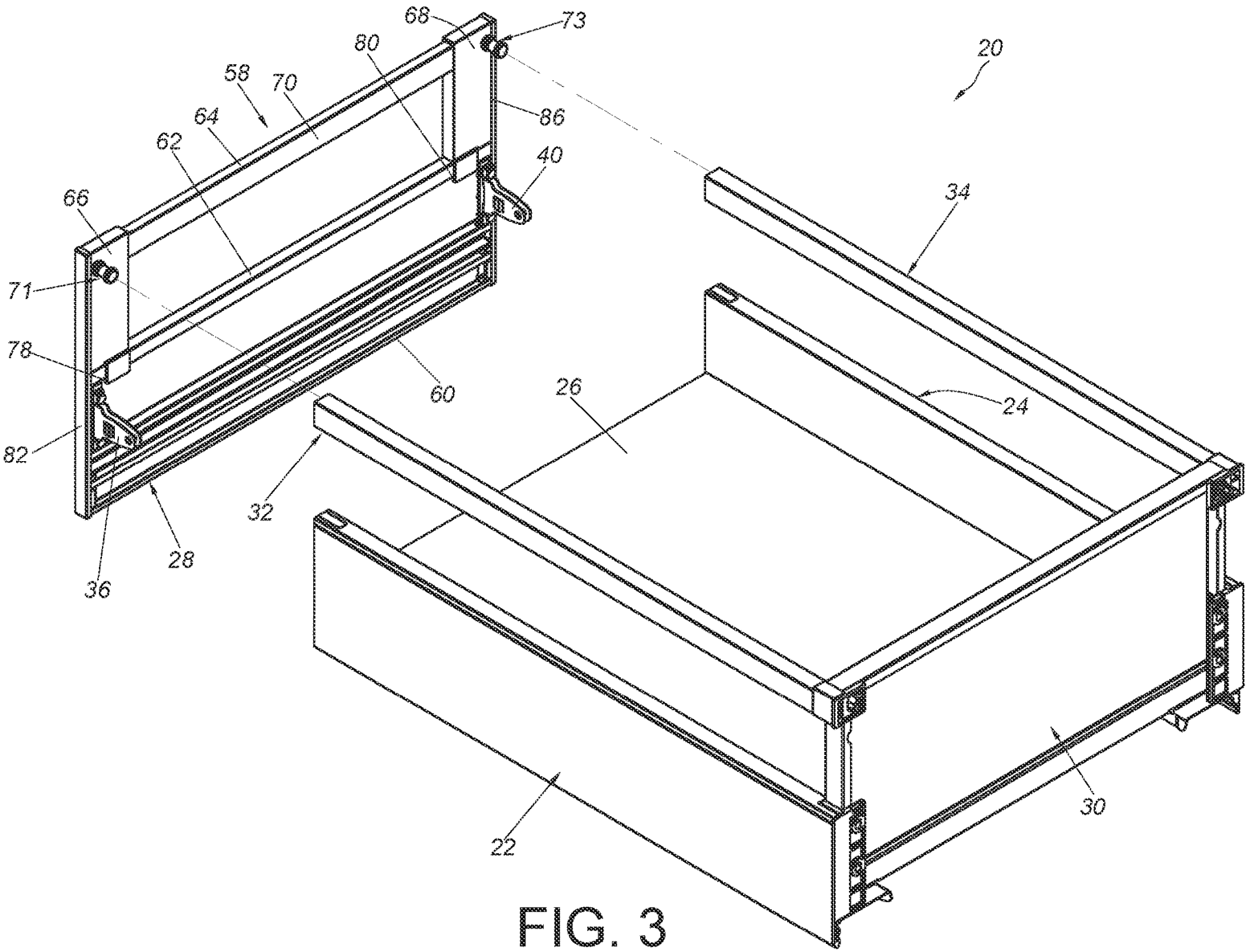
FIG. 3 is an exploded view of the furniture system from a second viewing angle according to the embodiment of the present invention.

As shown in FIG. 1 to FIG. 3, a furniture system 20 includes a first side wall 22, a second side wall 24, a bottom plate 26, a first panel 28 and a second panel 30 according to an embodiment of the present invention. In the present embodiment, the furniture system 20 is a drawer, but the present invention is not limited thereto.

The first side wall 22 and the second side wall 24 are arranged at a left side and a right side of the bottom plate 26 respectively. The left and right sides are only for illustration to facilitate understanding of relative positions, that is, the left and right sides are interchangeable, and are not intended to limit the specific positions. On the other hand, the first panel 28 and the second panel 30 are arranged at a front side and a rear side of the bottom plate 26 respectively. For example, the first panel 28 is a front panel, and the second panel 30 is a rear panel (or back panel), but the present invention is not limited thereto.

The first side wall 22, the second side wall 24, the bottom plate 26, the first panel 28 and the second panel 30 together define an accommodating space for accommodating objects.

In the present embodiment, the X-axis is a length direction of the furniture system 20, the Y-axis is a width direction of the furniture system 20, and the Z-axis is a height direction of the furniture system 20. The length direction, the width direction and the height direction are perpendicular to each other. In addition, left and right sides of the furniture system 20 have substantially identical structural arrangement. In response to user requirements, the left side and the right side of the furniture system 20 can be respectively arranged with a first elevated member 32 and a second elevated member 34 to increase heights of the left and right sides of the furniture system 20, so as to match heights of the first panel 28 and the second panel 30.

Preferably, the first panel 28 can be mounted to a first corresponding part 38 of the first side wall 22 through a first mounting member 36, and/or the first panel 28 can be mounted to a second corresponding part 42 of the second side wall 24 through a second mounting member 40. Such configuration is well known to those skilled in the art, for simplification, no further illustration is provided.

Figure 4:
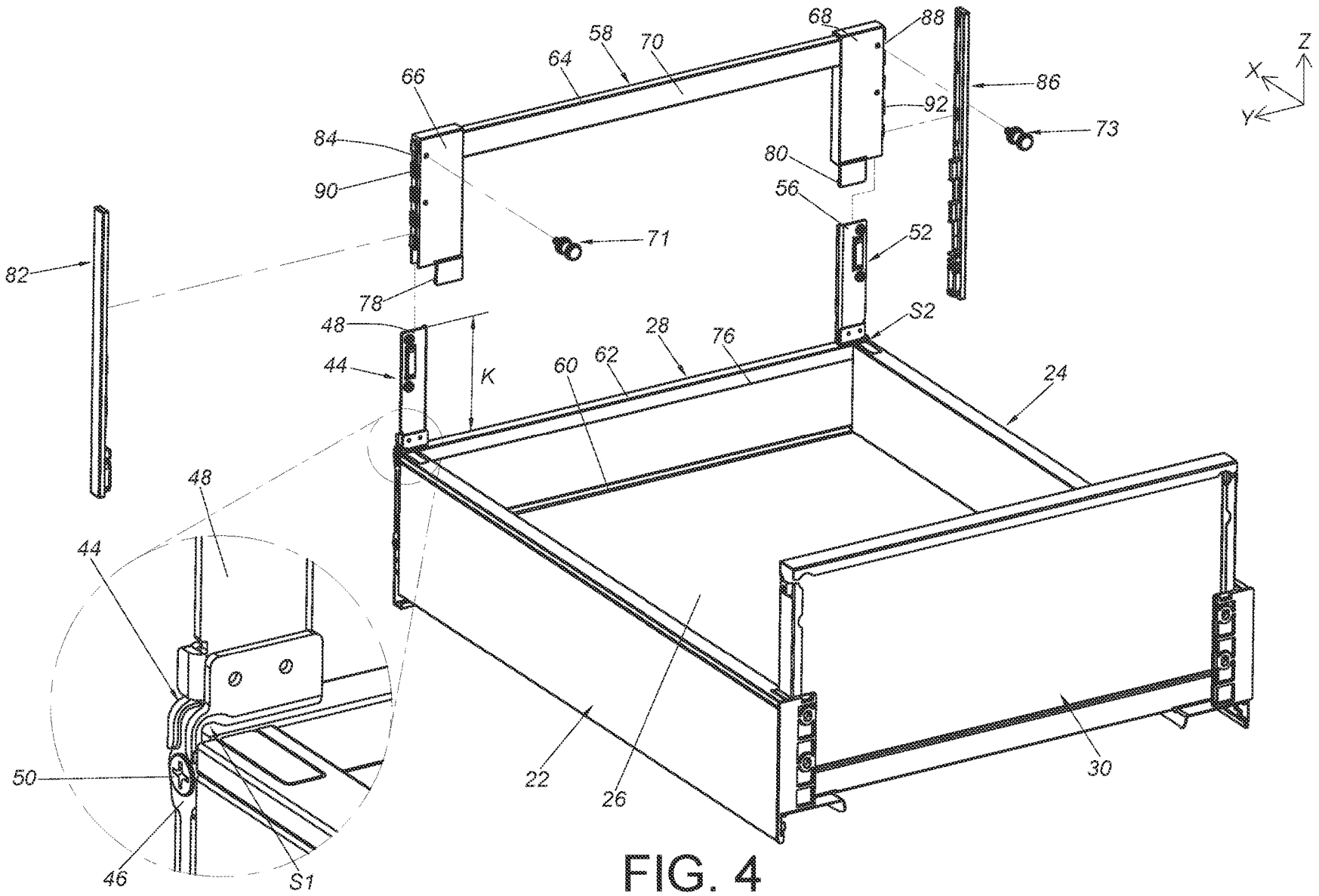
FIG. 4 is an exploded view of a furniture assembly according to the embodiment of the present invention.
Figure 5:
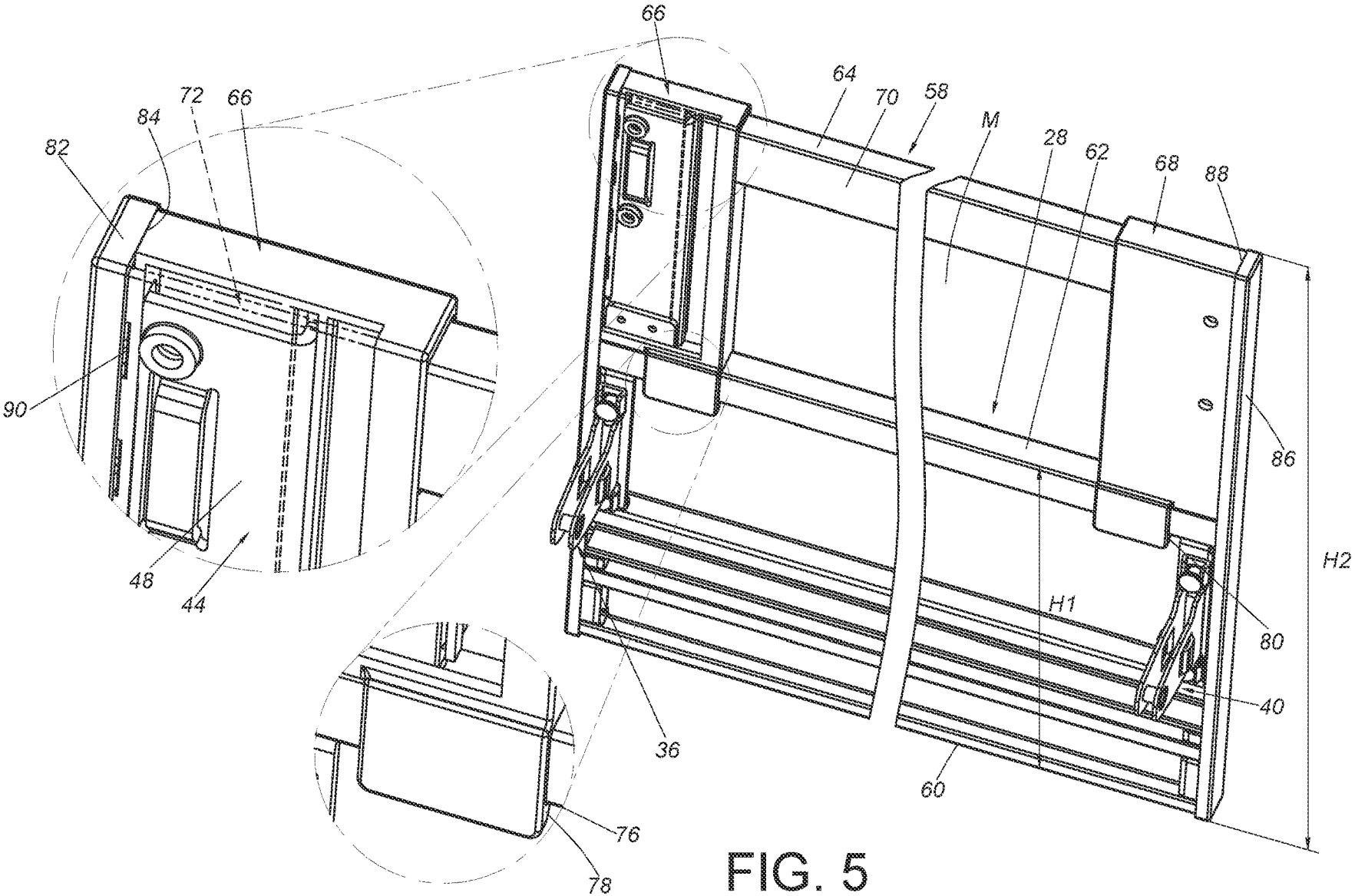
FIG. 5 is a diagram showing an auxiliary device of the furniture assembly being mounted to a first panel according to the embodiment of the present invention.

Please refer to FIG. 4 and FIG. 5. The first elevated member 32 and the second elevated member 34 are omitted in FIG. 4.

Furthermore, the first panel 28 has a first side S1 and a second side S2 opposite to the first side S1. The furniture system 20 further comprises a first connecting member 44 arranged adjacent to the first side S1 of the first panel 28. The first connecting member 44 comprises a first part 46 and a second part 48. The first part 46 of the first connecting member 44 is configured to be connected to the first side S1 of the first panel 28. For example, the first part 46 of the first connecting member 44 is connected (such as fixed) to the first side S1 of the first panel 28 through at least one fastening member 50 (as shown in FIG. 4). Similarly, the furniture system 20 further comprises a second connecting member 52 arranged adjacent to the second side S2 of the first panel 28. The second connecting member 52 comprises a first part (not shown in FIG. 4 due to viewing angle) and a second part 56. The first part of the second connecting member 52 is configured to be connected to the second side S2 of the first panel 28.

The furniture system 20 further comprises an auxiliary device 58 configured to be mounted to the second part 48 of the first connecting member 44 and/or the second part 56 of the second connecting member 52. In the present embodiment, the auxiliary device 58 is configured to be mounted to the second part 48 of the first connecting member 44 and the second part 56 of the second connecting member 52.

The first panel 28, the first connecting member 44 and the auxiliary device 58 together form a furniture assembly. The auxiliary device 58 is configured to increase a height of the furniture assembly above the first panel 28.

Preferably, the auxiliary device 58 is detachably mounted to the second part 48 of the first connecting member 44 and/or the second part 56 of the second connecting member 52.

Preferably, the first panel 28 comprises a bottom part 60 and a top part 62, and a first predetermined height H1 is defined between the top part 62 and the bottom part 60 of the first panel 28. When the auxiliary device 58 is mounted to the second part 58 of the first connecting member 44, a second predetermined height H2 is defined between a top part 64 of the auxiliary device 58 and the bottom part 60 of the first panel 28 (as shown in FIG. 5), and the second predetermined height H2 is higher than the first predetermined height H1.

Preferably, the second part 48 of the first connecting member 44 is extended from the first part 46. In the present embodiment, the second part 48 of the first connecting member 44 is substantially perpendicularly connected to the first part 46, and the second part 48 of the first connecting 44 is extended beyond the top part 62 of the first panel 28 by a predetermined distance K (as shown in FIG. 4). The second connecting member 52 has substantially identical structural configuration as the first connecting member 44, for simplification, no further illustration is provided.

The auxiliary device 58 comprises a first fitting member 66, a second fitting member 68 and an extension member 70 arranged between the first fitting member 66 and the second fitting member 68. For example, the extension member 70 is connected between the first fitting member 66 and the second fitting member 68.

Preferably, the auxiliary device 58 is configured to be mounted to the second part 48 of the first connecting member 44 through the first fitting member 66. In the present embodiment, the first fitting member 66 is configured to sleeve the second part 48 of the first connecting member 44 (as shown in FIG. 4 and FIG. 5). For example, one of the first fitting member 66 and the second part 48 of the first connecting member 44 is formed with a mounting space 72 (such as a groove), and the other one of the first fitting member 66 and the second part 48 of the first connecting member 44 is configured to be inserted into the mounting space 72 (as shown in FIG. 5), such that the first fitting member 66 and the second part 48 of the first connecting member 44 can be connected to each other. Similarly, the second fitting member 68 is configured to sleeve the second part 56 of the second connecting member 52, such that the second fitting member 68 and the second part 56 of the second connecting member 52 can be connected to each other. For simplification, no further illustration is provided.

Figure 6:
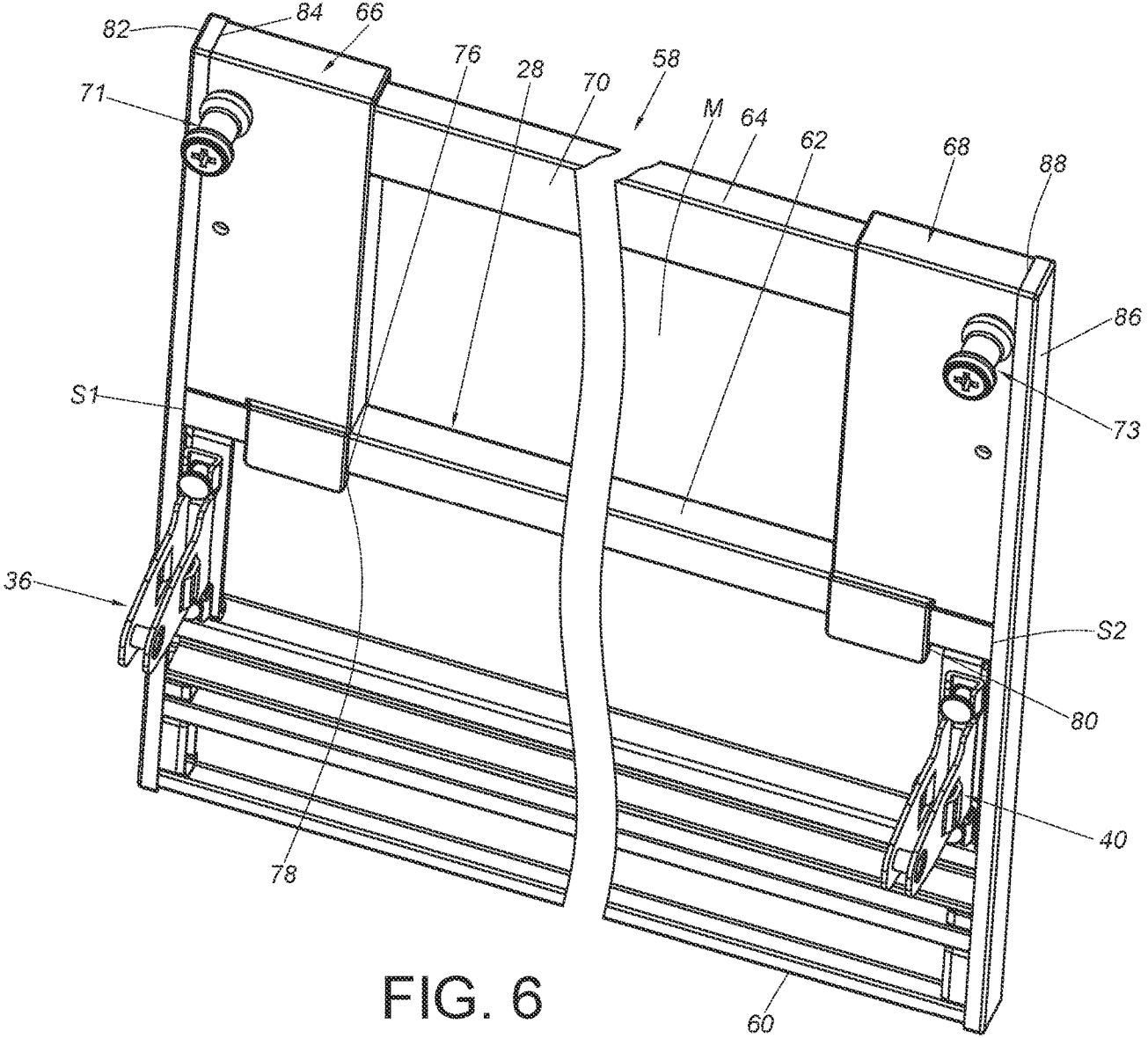
FIG. 6 is a diagram showing the auxiliary device of the furniture assembly being fixed to the first panel according to the embodiment of the present invention.

As shown in FIG. 4 to FIG. 6, the furniture system 20 further comprises a first fixing member 71 configured to fixedly connect the first fitting member 66 with the first connecting member 44 to each other. Similarly, the furniture system. 20 further comprises a second fixing member 73 configured to fixedly connect the second fitting member 68 with the second connecting member 52.

Preferably, the first fixing member 71 is configured to be mounted to a first corresponding feature 75 of the first elevated member 32, and the second fixing member 73 is configured to be mounted to a second corresponding feature 77 of the second elevated member 34 (please refer to FIG. 2 and FIG. 3).

Preferably, the first panel 28 comprises a predetermined portion 76. At least one of the first fitting member 66 and the second fitting member 68 is arranged with a hook configured to engage with the predetermined portion 76 of the first panel 28. In the present embodiment, the first fitting member 66 is arranged with a first hook 78, and the second fitting member 68 is arranged with a second hook 80.

Preferably, the first hook 78 and the second hook 80 are elastic. For example, the first hook 78 and the second hook 80 are made of plastic; in other alternative embodiment, the first hook 78 and the second hook 80 are made of metal, but the present invention is not limited thereto.

Preferably, the extension member 70 is a rod, and the extension member 70, the first fitting member 66, the second fitting member 68, and the top part 62 of the first panel 28 together define a predetermined space M (as shown in FIG. 5 and FIG. 6).

Preferably, the furniture system 20 further comprises a first side cover 82, and the first fitting member 66 comprises a first side part 84. The first side cover 82 is configured to cover the first side part 84 of the first fitting member 66 and the first side S1 of the first panel 28. Similarly, the furniture system 20 further comprises a second side cover 86, and the second fitting member 68 comprises a second side part 88. The second side cover 86 is configured to cover the second side part 88 of the second fitting member 68 and the second side S2 of the first panel 28.

Preferably, one of the first side cover 82 and the first side part 84 of the first fitting member 66 has at least one first connecting feature 90, such as a protrusion or an auxiliary hook, configured to connect the other one of the first side cover 82 and the first side part 84 of the first fitting member 66, such that the first side cover 82 and the first side part 84 of the first fitting member 66 are pressed against each other or buckled together. Similarly, one of the second side cover 86 and the second side part 88 of the second fitting member 68 has at least one second connecting feature 92, such as a protrusion or an auxiliary hook, configured to connect the other one of the second side cover 86 and the second side part 88 of the second fitting member 68, such that the second side cover 86 and the second side part 88 of the second fitting member 68 are pressed against each other or buckled together.

Figure 7:
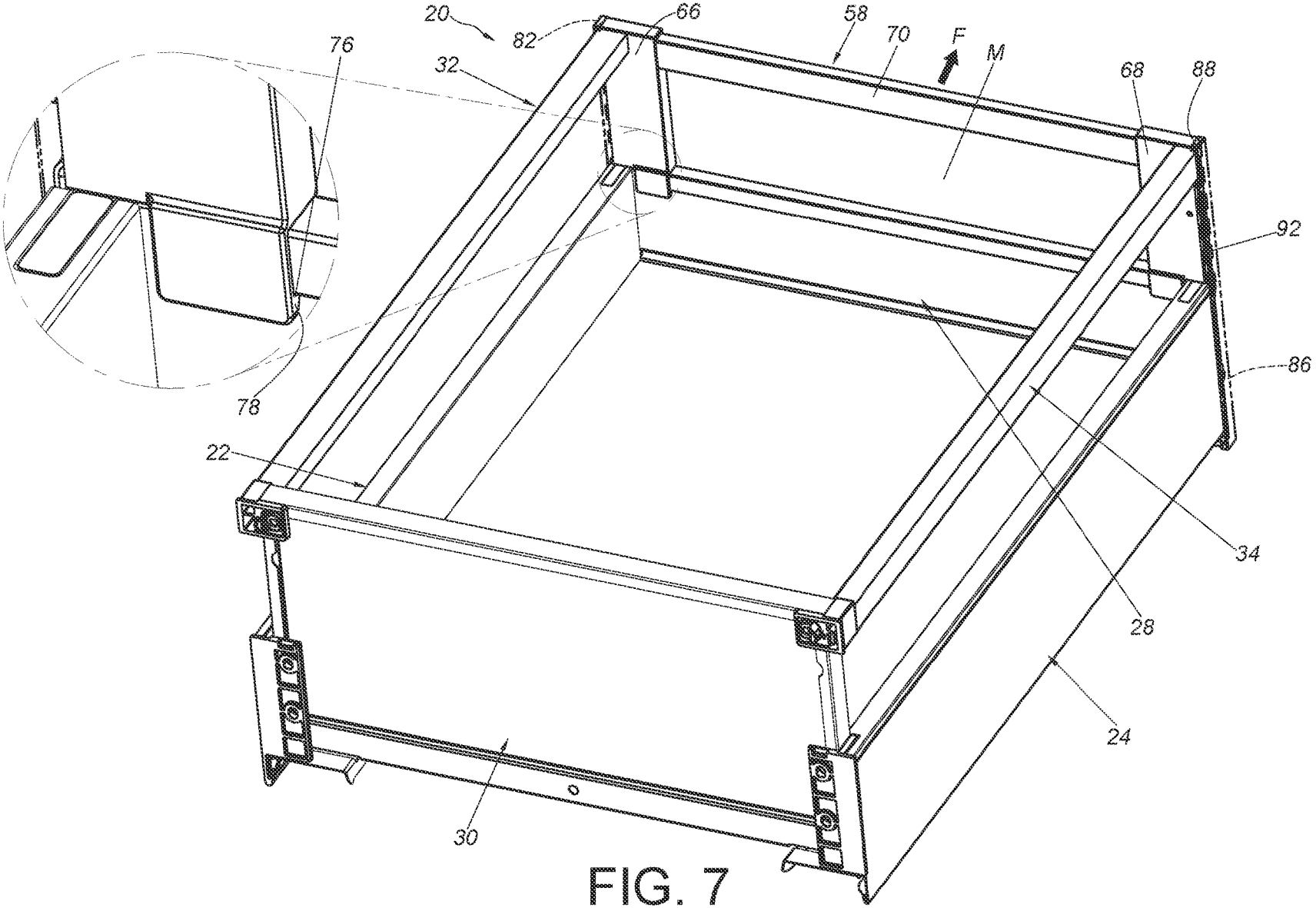
FIG. 7 is a diagram showing the furniture system being moved by a force along a predetermined direction according to the embodiment of the present invention.

As shown in FIG. 7, a user can put his hand into the predetermined space M, and hold the auxiliary device 58 (the extension member 70 of the auxiliary device 58) to apply a force F to open the furniture system 20 relative to a cabinet (not shown in figures) along a predetermined direction (such as an opening direction). Through engaging the first hook 78 of the first fitting member 66 (and/or the second hook 80 of the second fitting member 68) with the first panel 28 (the predetermined position 76 of the first panel 28), the auxiliary device 58 (with the second part 48 of the first connecting member 44 and/or the second part 56 of the second connecting member 52) can be prevented from being tilted or deformed relative to the first panel 28 due to unexpected movement of the auxiliary device 58 in order to improve structural strength and reliability of the auxiliary device 58.

Figure 8:
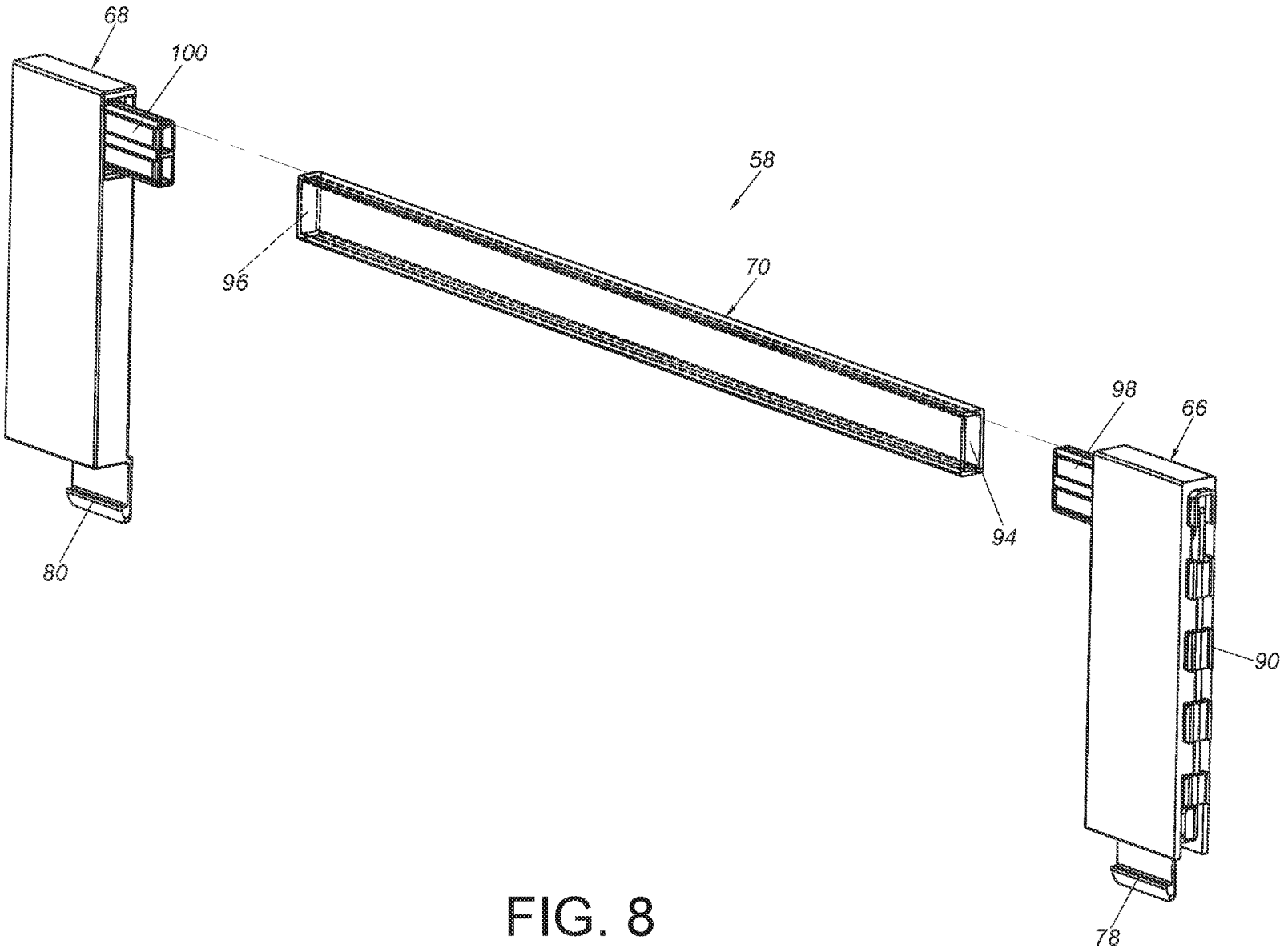
FIG. 8 is an exploded view showing the auxiliary device according to the embodiment of the present invention.

As shown in FIG. 8, the extension member 70 of the auxiliary device 58 has a first side end 94 and a second side end 96 opposite to the first side end 94. The first fitting member 66 is configured to be detachably mounted to the first side end 94. The second fitting member 68 is configured to be detachably mounted to the second side end 96. For example, the first side end 94 of the extension member 70 is formed with a first accommodating space configured to mount a first extension part 98 of the first fitting member 66, and the second side end 96 of the extension member 70 is formed with a second accommodating space configured to mount a second extension part 100 of the second fitting member 68. Through the aforementioned detachable mounting configuration, the auxiliary device 58 can meet diverse mounting requirements of the market. However, the extension member 70, the first fitting member 66 and the second fitting member 68 of the auxiliary device 58 can also be integrated together, but the present invention is not limited thereto.

Therefore, the furniture system and the furniture assembly according to the embodiments of the present invention have the following technical features:

1. The auxiliary device 58 is configured to be (detachably) mounted to the second part 48 of the first connecting member 44, such that the height of the furniture assembly above the first panel 28 can be increased by adding the auxiliary device 58 according to the user's requirements.
2. Through engaging the first hook 78 of the first fitting member 66 (and/or the second hook 80 of the second fitting member 68) with the first panel 28, the auxiliary device 58 can be prevented from being tilted or deformed relative to the first panel 28 due to unexpected movement of the auxiliary device 58, in order to improve structural strength and reliability of the auxiliary device 58.
3. In contrast to the prior art, the furniture system and the furniture assembly provided by the embodiments of the present invention do not have any locking element in a form of a clamping arm disclosed in the prior art. In addition, according to embodiments of the present invention, the first side cover 82 is configured to cover the first side part 84 of the first fitting member 66 and the first side S1 of the first panel 28, and the second side cover 86 is configured to cover the second side part 88 of the second fitting member 68 and the second side S2 of the first panel 28, such that after the assembly of the furniture system 20 is completed, the two opposite sides of the first panel 28 and the auxiliary device 58 can be covered and decorated to have dustproof effect with good appearance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A furniture assembly, comprising:

a first panel having a first side and a second side;

a connecting member arranged adjacent to one of the first side and the second side of the first panel, the connecting member comprising a first part and a second part, the first part being configured to be fixedly connected to the first panel; and an auxiliary device configured to be mounted to the second part of the connecting member, in order to increase a height of the furniture assembly above the first panel;

wherein the first panel comprises a bottom part and a top part, and a first predetermined height is defined between the top part and the bottom part of the first panel; wherein when the auxiliary device is mounted to the second part of the connecting member, a second predetermined height is defined between a top part of the auxiliary device and the bottom part of the first panel, and the second predetermined height is higher than the first predetermined height;

wherein the second part of the connecting member is extended upward from the first part along a height direction of the first panel, and the second part of the connecting member is extended beyond the top part of the first panel by a predetermined distance;

wherein the auxiliary device comprises a first fitting member, a second fitting member and an extension member arranged between the first fitting member and the second fitting member;

wherein the first fitting member is formed with a mounting space corresponding to the second part of the connecting member;

wherein when the first part of the connecting member is fixedly connected to the first panel, the first fitting member is configured to be moved downward along the height direction of the first panel relative to the second part of the connecting member in order to insert the second part of the connecting member into the mounting space, so as to mount the auxiliary device to the second part of the connecting member.

2. The furniture assembly of claim 1, wherein the first fitting member is configured to sleeve the second part of the connecting member.

3. The furniture assembly of claim 1, wherein the first panel comprises a predetermined portion, and one of the first fitting member and the second fitting member is arranged with a hook configured to engage with the predetermined portion of the first panel.

4. The furniture assembly of claim 3, wherein the hook is elastic.

5. The furniture assembly of claim 1, wherein the extension member has a first side end and a second side end, and the first fitting member is configured to be detachably mounted to the first side end.

6. The furniture assembly of claim 5, wherein the second fitting member is configured to be detachably mounted to the second side end.

7. The furniture assembly of claim 1, wherein the extension member is a rod, and a predetermined space is defined by the extension member, the first fitting member, the second fitting member and the top part of the first panel.

8. The furniture assembly of claim 1, further comprising a side cover, wherein the first fitting member comprises a side part, and the side cover is configured to cover the side part of the first fitting member and the first side of the first panel.

9. A furniture system, comprising:

a bottom plate;

a first side wall and a second side wall arranged at left and right sides of the bottom plate respectively;

a first panel and a second panel arranged at front and rear sides of the bottom plate respectively, the first panel having a first side and a second side;

a connecting member arranged adjacent to one of the first side and the second side of the first panel, the connecting member comprising a first part and a second part, the first part being configured to be fixedly connected to the first panel; and an auxiliary device configured to be detachably mounted to the second part of the connecting member;

wherein the first panel comprises a bottom part and a top part, and a first predetermined height is defined between the top part and the bottom part of the first panel; wherein when the auxiliary device is mounted to the second part of the connecting member, a second predetermined height is defined between a top part of the auxiliary device and the bottom part of the first panel, and the second predetermined height is higher than the first predetermined height;

wherein the second part of the connecting member is extended upward from the first part along a height direction of the first panel, and the second part of the connecting member is extended beyond the top part of the first panel by a predetermined distance;

wherein the auxiliary device comprises a first fitting member and an extension member connected to the first fitting member;

wherein the first fitting member is formed with a mounting space corresponding to the second part of the connecting member;

wherein when the first part of the connecting member is fixedly connected to the first panel, the first fitting member is configured to be moved downward along the height direction of the first panel relative to the second part of the connecting member in order to insert the second part of the connecting member into the mounting space, so as to mount the auxiliary device to the second part of the connecting member.

10. The furniture system of claim 9, wherein the first panel comprises a predetermined portion, and the first fitting member is arranged with a hook configured to engage with the predetermined portion of the first panel.

* * * * *